US009972288B2

(12) United States Patent
Baer

(10) Patent No.: US 9,972,288 B2
(45) Date of Patent: May 15, 2018

(54) ACTION-SET ADJUSTABLE GUITAR NECK ATTACHMENT APPARATUS

(71) Applicant: Douglas Wayne Baer, Lacey, WA (US)

(72) Inventor: Douglas Wayne Baer, Lacey, WA (US)

( * ) Notice: Subject to any disclaimer, the term of this patent is extended or adjusted under 35 U.S.C. 154(b) by 0 days. days.

(21) Appl. No.: 15/450,454

(22) Filed: Mar. 6, 2017

(65) Prior Publication Data

US 2017/0178602 A1 Jun. 22, 2017

Related U.S. Application Data

(60) Provisional application No. 62/304,516, filed on Mar. 7, 2016.

(51) Int. Cl.
*G10D 3/06* (2006.01)
*G10D 1/08* (2006.01)

(52) U.S. Cl.
CPC ..... *G10D 3/06* (2013.01); *G10D 1/08* (2013.01)

(58) Field of Classification Search
CPC ..... G10D 1/08
See application file for complete search history.

(56) References Cited

U.S. PATENT DOCUMENTS 5,886,272 A * 3/1999 Regenberg ..... G10D 3/06 84/291
2014/0144306 A1* 5/2014 Seal ..... G10D 1/005 84/291

* cited by examiner

*Primary Examiner* — Kimberly Lockett

(57) ABSTRACT

This apparatus and system provides an acoustic hollow body guitar which allows for the careful adjustment of the instrument neck to body relative angle of inclination and thus the string to fret distance (action height). This adjustment has the capability of being accomplished while the guitar is in the tuned state and in the playing position. The traditional wood jointing is abandoned and replaced by a guitar neck to body hinge-less mounting bracket assembly apparatus. This system employs a single adjusting nut/dial that is accessed through either/and a port in the side of the upper bout or the sound-hole.

8 Claims, 7 Drawing Sheets

ACTION-SET ADJUSTABLE GUITAR NECK ATTACHMENT APPARATUS

CROSS REFERENCES TO RELATED APPLICATIONS

Application No. 62/304,516 . . . Mar. 7, 2016

STATEMENT REGARDING FEDERALLY SPONSORED RESEARCH OR DEVELOPMENT

Not Applicable

NAMES OF PARTIES TO A JOINT RESEARCH AGREEMENT

Not Applicable

REFERENCE TO A "SEQUENCE LISTING"

Not Applicable

STATEMENT REGARDING PRIOR DISCLOSURES BY THE INVENTOR

Not Applicable

CITED REFERENCES

U.S. Patent Documents

| | | | |
|---|---|---|---|
| 1,371,760 | Mar. 15, 1921 | Grover | 84/269 |
| 1,707,192 | Mar. 26, 1929 | Overton | 84/267 |
| 1,932,975 | Oct. 31, 1933 | Kuhrmeyer | 84/293 |
| 2,113,416 | Apr. 5, 1938 | Gugino | 84/293 |
| 3,196,730 | Jul. 27, 1965 | Daniel | 84/293 |
| 5,886,272 | Mar. 23, 1999 | Regenberg | 84/293 |
| 6,051,766 | Apr. 18, 2000 | Taylor | 84/293 |

BACKGROUND OF INVENTION

1. Field of the Invention

The present invention is directed to acoustic stringed musical instruments, specifically, guitars and other hollow body instruments with fretted necks.

2. Description of the Related Art

Guitars and other fretted neck stringed instruments, unlike bowed stringed instruments, have the inherent trait of not having consistent intonation the full length of their neck, or fretboard. This being due to a guitar's various notes are dictated by the placement of its frets. These fret placements are chosen using the principle of harmonic equal temperament, and the strings behave under the properties of just temperament, This being caused due to the string to fret distance progressively increasing the length of the fret board. Being greatest at the higher registers. This increased string to fret distance compounds the tension of the string during the fingering of a note, therefore, slightly varying the pitch to a sharper value. The string height on guitars is referred to as; string action. Therefore, luthiers are forced to compromise between these two conflicting properties.

On acoustic guitars a negative neck angle of approximately 1 degree is desirable in order to maintain a slight string break angle at the bridge saddle, this being done for tonal and volume purposes. The height of the bridge saddle from sound board surface is also very specific for acoustic considerations.

It is paramount that the guitar neck to body joint and neck angle of inclination relative it's body top plate (soundboard) to be as perfect as possible, to achieve intonation as near perfect as possible at the desired string action.

Traditional acoustic guitars makers have always coupled the neck to the body using traditional wood working technics. Essentially, block to block joints: variations of mortis and tenon, dovetail, or combinations thereof. Bonded by gluing with/or by mechanical fastening (screws, etc.).

Most have employed a system where one half of the joint is on the neck, known as the heel, a carved wood block either glued or carved into the neck. Normally beginning at the twelfth fret and ending at neck to body junction, the fourteenth fret. The second half of the joint, known as a neck block, is located inside the body connected to the guitar rim adjacent to the neck. Heelless necks have also been used less frequently. In this joint the neck block inside the guitar is quite large and extends almost to the sound hole. A rectangular neck pocket is machined into the top of the guitar body and the neck tail is shaped such that it transcends from a rounded shape into rectangular at the fourteenth fret and drops into the pocket and is held in place by four long screws that pass through holes drilled in the back of the guitar Another of luthiers' many considerations, when instrument building is bridge lift. When guitar strings are tuned to proper pitch the stress on the sound board at the string ends connection at the bridge results in a strain causing the sound board to convex upward, slightly, at the bridge region. The amount of this bridge lift is dependent upon the individual soundboard's stiffness, the stiffer the soundboard the less lift. With wood constructed guitars no two soundboards are identical, and have varying degrees of stiffness. Therefore, the actual bridge lift characteristics of each soundboard is only guessable but not absolutely predictable. The amount of bridge lift results in the equal variance in string height. The above is most problematic with steel string instruments, less so with nylon strung instruments and not at all in composite material constructed guitars. Higher end guitars sometimes require intensive labor reworking of the neck set-in before obtaining the desired string action height.

Wood guitars are susceptible to humidity, temperature, seasons, etc. And a guitar's action is in a constant state of wandering. Guitars require constant maintenance in this regards. Up to and including neck resets. Composite and other non-wood constructed instruments do not share these characteristics with wood guitars. Another phenomenon which occurs from the ageing of the guitar is that the various members, primarily, the sound board strain under the tension of the strings. And eventually, will become permanently fixed, in what luthiers call "creep". Steel strings of thicker gage with their increased tension exuberates this problem. Over time, all acoustic guitars tend to hinge about the neck to body joint and to suffer from a rising soundboard. Under the continual strain from the string tension, the action height gradually increases and the guitar becomes less and less playable. With a traditional set neck, correcting this problem, by re-setting the neck, is a highly skilled and expensive business.

Guitar players and collectors, like luthiers, tend to be very traditional and understand that a highly crafted guitars are cherished and need periodic maintenance and happily care for such instruments. A great guitar is an art object.

Mass produced guitars, on the other hand, especially, entry level guitars where cost of production constants apply.

The attention to a guitar's set-up and playability is little to nonexistent and resultant instruments playability are not consistent from one instrument to the next.

Throughout the history of the guitar up to the present, there have been hundreds of innovations regarding adjustable neck angle. Beginning in the early nineteenth century with luthier Johan Stauffer's hinged neck, adjusted by turning a square clock-key-style screw through a hole in the neck heel.

These innovations and apparatuses have relied upon modifications of the basic wood joints. with and without the employment of various adjustment components: screws, levers, shims, hinges, pivots, and various combinations thereof. A good system with a single simple adjustment, able to be done under tuned string tension and in the playing position as of yet, has not seen the marketplace.

Of benefit with a simple neck angle adjustment, would be in guitar manufacturing. Guitar builders who produce models with incorporated neck angle adjustment would have the advantage of easily and economically making fine adjustment in string action after production, resulting in excellent playability. Secondly, guitar players would have the option to adjust string action to their own personal preference. Ideally these adjustments would be simple and able to be done with the guitar strings under tuned tension.

The sector of the mass produced market is especially important because nearly all players learn on entry-level instruments, but unfortunately the quality of setup is often poor compared to instruments built by luthiers. Unfortunately beginners learn on the hardest to play instruments.

With composite material constructed guitars (synthetic, carbon fiber and/or reinforced plastic, etc.) are mostly molded as single tubs consisting of the bottom portions of the neck and body in one piece, minus neck headstock top panel, fretboard and soundboard panel. These panels are then bonded to the tub. Unfortunately this molded construction technic renders said instrument's set-up permanent and not modifiable without compromising other acoustic elements.

BRIEF SUMMARY OF INVENTION

The inventor of the present invention has conceived and developed an apparatus and new method for the joining of neck to body of hollow body guitars and related instruments. This new invention abandons the traditional wood neck heel block mortis and tenon, dovetail or other wood set in jointing methods of the past.

The preferred embodiment of the invention consists of a simple three legged neck to body attachment bracket utilizing an adjustable turn buckle strut member at diagonal angle. This arrangement results in a sturdy, rigid and tight neck to body set-in, allowing for the arbitrary adjustment of the instrument's string action height without significantly effecting the intonation of the instrument.

An object of the present invention is to allow for the adjustment of the guitar neck angle of inclination, relative to the soundboard panel of the guitar body. While simultaneously compensating for the progressive change in scale length and intonation of the instrument The adjustment being done with a single nut/dial while the guitar is in the tuned state and in the playing position.

Further scope of the present invention will become apparent through a review of the accompanying drawings and the detailed description.

The described and pictured examples and embodiments indicating the preferred embodiments of the present invention are meant to be general in scope and are not intended to limit the breadth of the present invention. Various changes and modifications within the spirit and scope of the invention will become apparent to those skilled in the related art.

BRIEF DESCRIPTION OF THE DRAWINGS

The construction, objective, operation, embodiment and function of the present invention will become apparent from the detailed description and the accompanying drawings which are provided for illustration purposes only and are not be construed as limiting the scope of the present invention. The drawings show.

DETAILED DESCRIPTION OF THE INVENTION

While the present invention may be embodied in many different forms, the present enclosed drawings and description, herein, detail a preferred embodiment and manner of assembly. The present disclosure is meant only as an exemplification of the present invention principles and is not intended to limit the invention to the particular embodiments illustrated.

Figure 1:
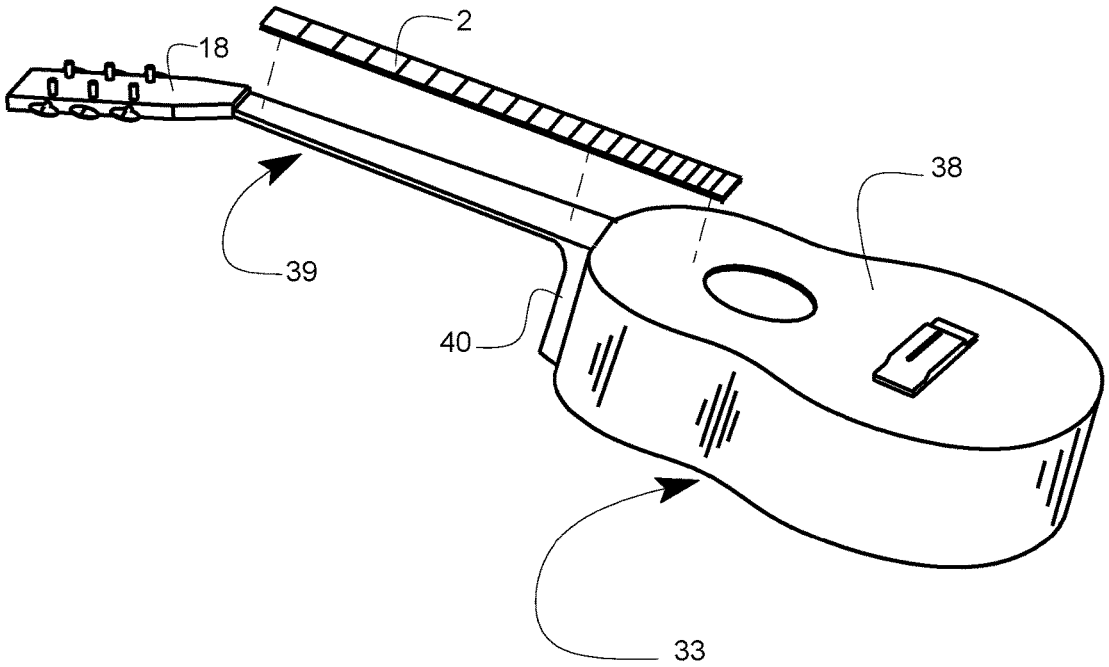
Fig. 1 PRIOR ART
FIG. 1 shows a perspective view of a prior art guitar, with the fretboard 2 detached from the neck 39.

FIG. 1 shows a guitar according to the prior art. The fret board 2 is depicted detached above and away from the guitar neck 39 and soundboard 38 of the guitar body 33. Note that the fret board 2 extends beyond the length of the neck 39 and onto the soundboard 38. Also note the heel 40 portion of the guitar neck 39. This heel 40 is the shaped joint block portion of the neck 39 that interlocks with the joint block just inside the body 33 immediately below the fretboard.

Figure 2:
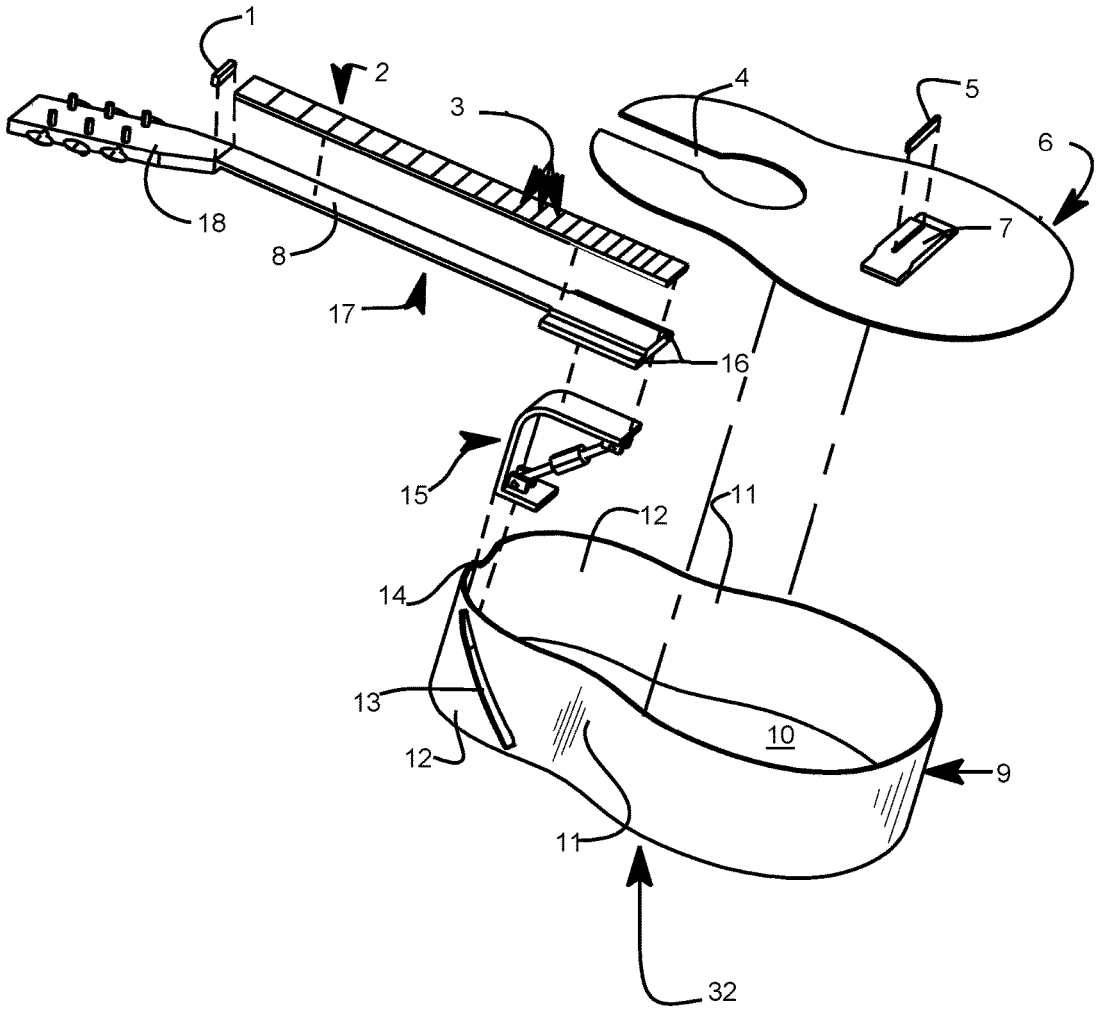
FIG. 2 shows an exploded perspective view of a guitar according to an embodiment of the present invention.

FIG. 2 shows an exploded perspective of a hollow body guitar according to the preferred embodiments of the present invention. The present invention can be adopted to other hollow body fretted stringed musical instruments. Because a hollow body guitar is the preferred embodiment of the present invention the descriptions of the various embodiments will be referenced to such a guitar.

Figure 6:
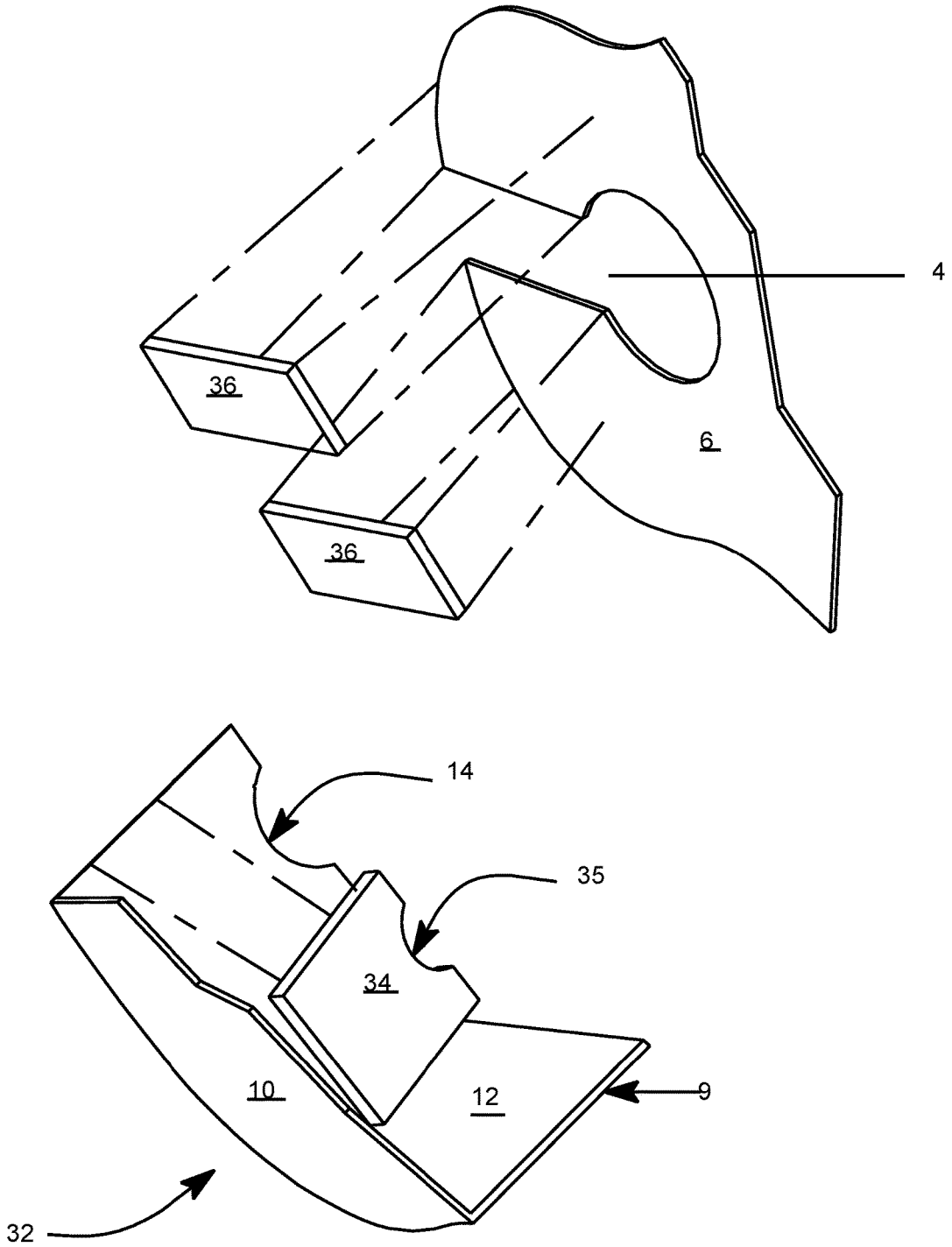
FIG. 6 shows a partial exploded perspective view of a guitar sound board and a partial view of a upper guitar body portion and the accompanying reinforcement members.

The present invention was originally conceived as a neck 17 to body 32 attachment method for use with a carbon fiber reinforced plastic (CFRP) composite guitar. The present invention does apply to all other used guitar construction materials: wood; ceramic; metal; plastic; polymers; elastomers; natural fiber; and/or any combination thereof. Everything described will apply to all other construction materials with one addition: wood and other materials with similar modulus (Young's Modulus) may require the addition of a reinforcing means comprised of veneer substrates as shown in FIG. 6 rim reinforcement veneer 34 and soundboard reinforcement veneer 36.

The guitar has a neck to body attachment bracket portion including an adjustment means; a neck portion; and a body portion including soundboard. Because said bracket will affect the subsequent relative angle of inclination of said neck the means of function will be referenced to said bracket.

Figure 3:
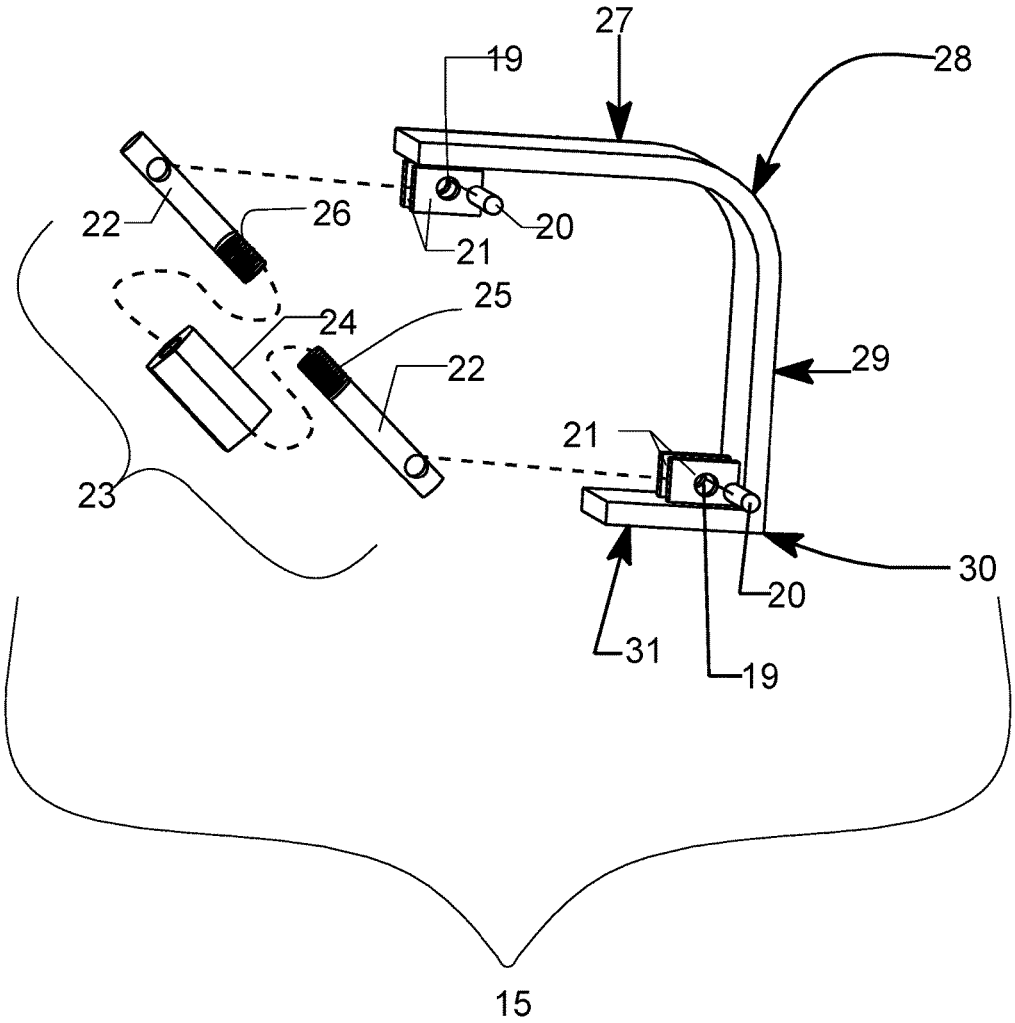
FIG. 3 shows an exploded perspective view of the bracket structure of the present invention, detailing the components and elements, thereof.

FIG. 3 The preferred fabrication of the neck attachment bracket 15 (less the turnbuckle strut assembly 23) is aluminum flat stock forming the top leg 27, the circular radius bend section 28 being the transition between the top leg 27 and the vertical leg 29 at a approximate relative ninety degree angle. The radius of bend section 28 being the longest possible while maintaining sufficient flat area of top leg for a secure joining to the neck blank FIG. 28 tail bottom surface. The transition 30 between the vertical leg 29 and the bottom leg 31 is a sharp square bend at an angle to match that of rim 9 relative to bottom board 10, or a short radius bend. The bracket thus forms a somewhat squared "C" shape, with a inside and outside surface. The strut attachment flat mount tab members 21 are tee-joint welded, as pairs, to the bracket legs 27,29. These bracket legs and tab members may also be fabricated as a single component. Although the preferred embodiment of the present invention is composed of aluminum any material of similar stiffness and modulus may be substituted, including: other metals; ceramics; natural fiber; wood; plastics; polymers; elastomers; and/or any combination thereof. Other fabrication methods may also be employed including: brake forming, press forming, press stamping, punch stamping, casting, forging, molding, press molding, injection molding, or any combination thereof. Alternately, a member of the adjustment means may be substituted for a mounting tab member.

FIG. 3 is a exploded perspective drawing of the neck attachment bracket assembly 15 apparatus, indicating the assembly's various components and elements. Elements of stated bracket assembly 15 include: bracket top leg 27 including a top, a bottom and a side surface; radius leg transition 28; vertical leg 29 including an inside and an outside surface; square transition 30; bottom leg; two pairs of parallel flat mount tabs 21 for the mounting of the turnbuckle assembly 2; link pin tab eyes 19; link pins 20. Acting as an adjustment means, a sub assemble consisting of a turnbuckle strut assembly 23 including: two threaded studs with eye 22, composed of aluminum round rod, one with right handed machine screw threads 25 and the other with left handed machine screw threads 26; and a barrel nut 24, composed of aluminum hexagon rod, with ends being machine nut threaded in opposite directions in order to receive the matching threading of the threaded studs 22 one right hand threaded 25 the other left hand threaded 26. Alternate turnbuckle material composition includes: ceramics; other metals; elastomers; polymers; and/or any combination thereof, of equal or suitable hardness and stiffness.

Alternately, a turnbuckle strut assemble may be employed, comprised of: round stock as a nut; square stock as a nut; hex stock as a strut stud; or square stock as a strut stud. A strut stud may be threaded on both ends. An order of configuration includes: one nut one stud; stud-nut-stud; and nut-stud-nut.

Of important note is regarding the pitch diameter/thread fit between the matching threads of the strut studs 22 to barrel nut 24. Any play or shake to the fit is objectionable, therefore the preferred thread fit is between a class 2 fit to a class 4 fit. Additionally, stepped slip fit stud to barrel nut fore and/or aft the threading may be utilized.

Figure 4:
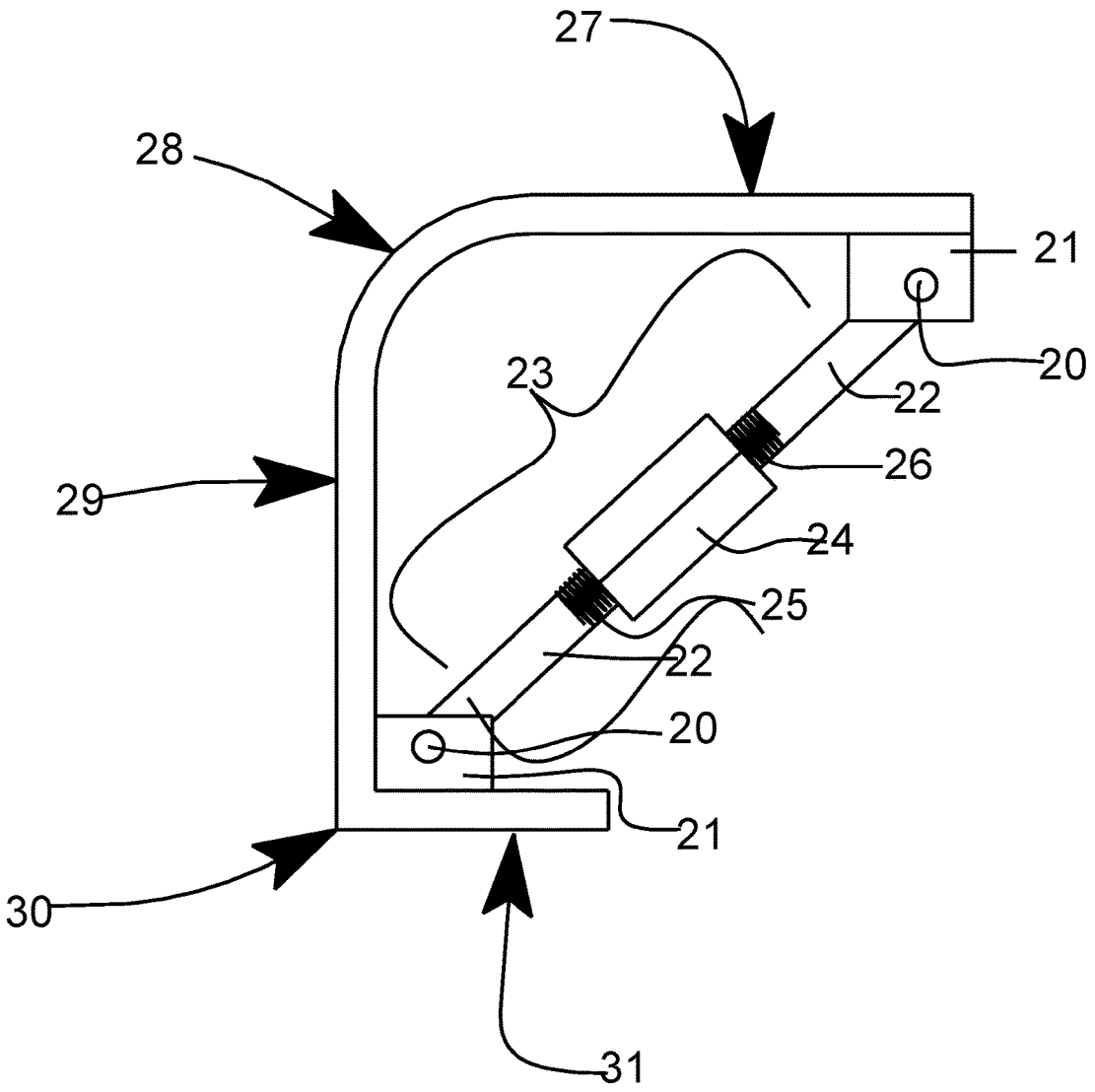
FIG. 4 shows the present invention in left side view.

FIG. 4 Through the adjusting, by rotating, the barrel nut 24 on the turnbuckle assembly 23. The top bracket leg 27 and vertical bracket leg 29 will either spread apart or narrow closer together. The direction of the parting depending upon the rotational direction of the barrel nut and hence the lengthening or shortening of the turnbuckle strut assembly 23. This adjusting imparts a bending force upon the prefixed circular arch radius bend 28, resulting in the progressive change in the actual length of radius of the radius bend 28 portion. This changing of the radius length results in the changing of the effective, center of radius, point of the radius arc, the theoretical pivot point. This in essence creates a very fine variable point of pivot and results in an elliptic arc throughout the range of adjustment. This elliptic arc somewhat compensates for the increase of string tension imparted during a finger's fretting of a note at higher adjusted action height. The preferred range of adjustment of the turnbuckle strut is a three degree angle relative to bracket top leg 27 and vertical leg 29 Two degrees negative and one degree positive.

FIG. 4 The turn buckle strut assembly 23 angle of attachment is diagonal from bracket top leg 27 to vertical leg 29 and perpendicular to the axis of the apex to radius center point of the radius bend 28. And at midpoint of the width of the bracket legs 27, 29, 31. Attachment tabs 21 should be positioned and located accordingly The experimental altering of the turnbuckle strut assembly diagonal angle, modifying the slope of the afore mentioned elliptic arc may be desired as alternate embodiments of the present invention. The strut assembly attachment between tab mounts 21 is by press fitted link pins 20 The barrel nut 24 may optionally be configured as a spur nut and/or fitted with protruding studs at right angles thus allowing for turn buckle adjustment by the use of a lever through the sound hole and using the end of neck 17 as the fulcrum.

The neck portion FIG. 2 17 includes: the neck blank 8, the neck head stock with tuners 18, the fret board 2 with frets 3, string nut 1 and a rectangular shaped neck tail section which runs the length of the stepped rabbet surfaces 16, the fourteenth fret to end of the end of neck. The neck portion may be made from a single piece of material, incorporating the fret board into this single piece, or from two or more pieces. The preferred material being CFRP but any traditional or suitably rigid material is acceptable: wood; ceramic; metal; plastic; elastomer; polymer; natural fiber; and/or any combination thereof.

FIG. 2 The guitar body 32 portion, comprised of a hollow box, including a rim 9 with waist 11; upper bout 12 with a neck recess 14 including a surface; an adjustment port 13, a slot cut at a perpendicular angle relative to the axis of turnbuckle strut barrel nut for use with a wench; a bottom board 10; a bridge 7 and bridge saddle 5; and a soundboard 6, with an internal and an exterior surface, and including a key hole cut-out 4 composed of both a sound port and the dedicated recess/relief for the corresponding acceptance of the neck blank 8 tail section. Tolerance between neck blank bottom surface and relief fit is as close as possible.

The assembly of the main portions of the guitar: the neck 17, fretboard 2, the body 32 including a soundboard 6 does not vary from that of conventional guitar assembly with four major exceptions:

First: Said soundboard is joined to said rim prior to attaching the neck.

Second: The fret board is joined to the neck if it is not already incorporated with the neck as singular unit. The frets should be fitted at this point according to ones desired scale length and spaced using the "rule of 18".

Figure 5A:
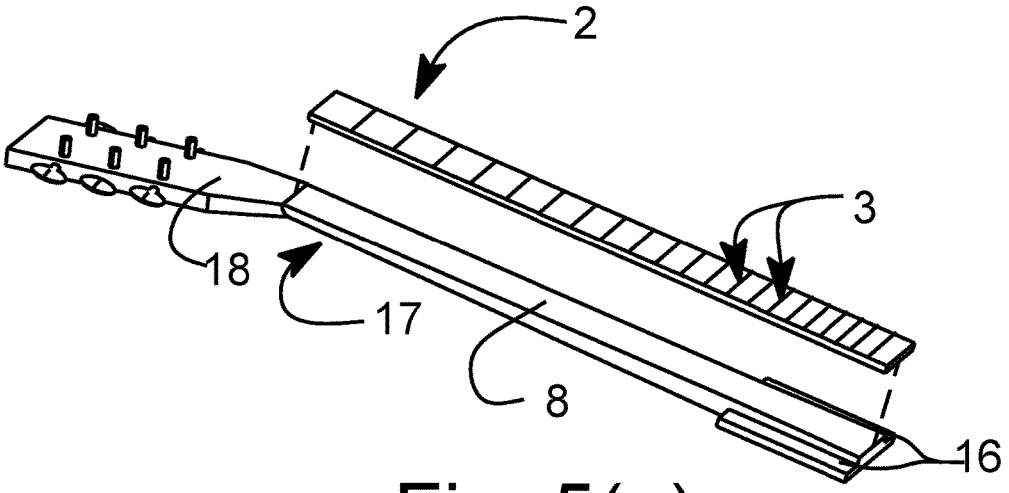
FIGS. 5(*a*) and 5(*b*) show perspective exploded views of two different embodiments of a guitar neck according to the present invention.
Figure 5B:
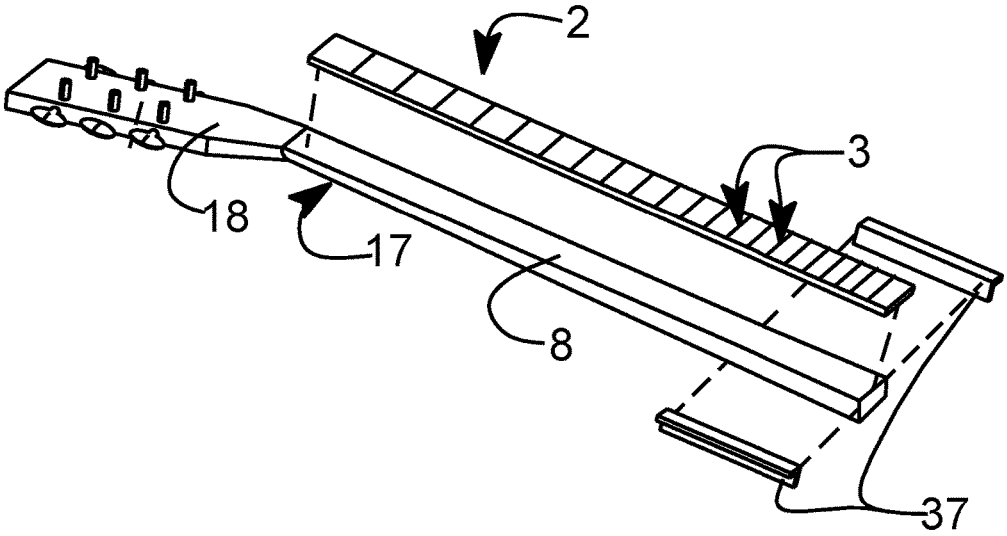

Third: The neck 17 extends the full length of the fret board 2 and the neck tail ($14^{th}$ fret to $20^{th}$ fret) is shaped rectangular with either machined stepped rabbet surfaces FIG. 5(*a*) 16 or with fin flanges FIG. 5(*b*) 37. These fin flanges are composed of aluminum angle stock. Alternately, the fin flanges may materially be composed of any suitable substance: ceramic; wood; metal; plastic; polymers; elastomers; natural fiber; and/or any combination thereof. The fin flanges are bonded by gluing one leg to the corresponding surface of the neck blank 8 tail section. Alternately, any commonly employed fastening methods: adhesives, epoxy or by mechanical means (screws, bolts, nut, rivets, etc.). These rabbets or fin flanges are inclined to a positive one degree angle relative to the neck blank 8 top plane and positioned with allowances for the thickness of the soundboard and the desired fretboard distance above soundboard top surface.

Fourth: The neck attachment bracket assembly 15 top leg 27 top surface is attached to the underside surface of the neck blank 8 tail. Bracket vertical leg 29 outside surface is attached to the guitar rim 9 upper bout 12 inside surface below the neck recess 14. The positioning of the top leg to neck mating is such that the top leg and neck are centered latitudinal. And longitudinally the neck should meet the rim 9 at the fourteenth fret position. The bottom leg 31 bottom surface is joined to guitar body bottom board. Joining of surfaces is by adhesive, integral and/or mechanical fastening: rivets; screws; bolts and nuts; cam locks; and backing plates. This configuration replaces the traditional neck set-in of wood jointing.

FIG. 2 the guitar body rim 9 recess 14 is cut to the profile of the respective corresponding mating section of the neck blank 8 and should be as tight of fit as is possible. There is no bonding at this mating as this is a pivot point.

The not yet stated joining points of the assembled guitar are as follows: The bracket bottom leg 31 to bottom board 10 corresponding to the respective surfaces. The respective surfaces of the soundboard 6 surface to the corresponding respective fin flange 37 or rabbet surfaces 16.

The corresponding joining surfaces may be joined by adhesive, integral and/or mechanical fastening: rivets; screws; bolts and nuts; cam locks; and backing plates. Most mechanical fastening methods will lend the guitar with the convenience of easy disassembly and reassembly during matters of repair, modifications, etc.

FIG. 6 shows reinforcing substrates, composed of a double ply veneer of unidirectional fabric CFRP, used in cases when the guitar construction materials are not of sufficient modulus of elasticity to withstand the distortional forces applied by the neck attachment bracket assembly 15 throughout the range of adjustment and, thus, requires a means of reinforcement. Rim reinforcement veneer 34 serves as an intermediate substrate between the guitar rim 9 and the bracket vertical leg 29 and can also double as a jointing member in cases where the rim is composed of two jointed halves, in this case the veneer 34 may be substituted with a wood substrate. Soundboard reinforcement veneers 36 are bonded to the respective underside surface region of soundboard keyhole 4 and serves as an intermediate substrate between soundboard 6 and neck tail rabbet 16 or fin flange 37 surfaces. or on the respective exterior soundboard surface. The veneers may be composed of any material or composite with suitable modulus of elasticity. A veneer substrate between bracket bottom leg 31 and guitar body bottom board 10 is optional.

Figure 7:
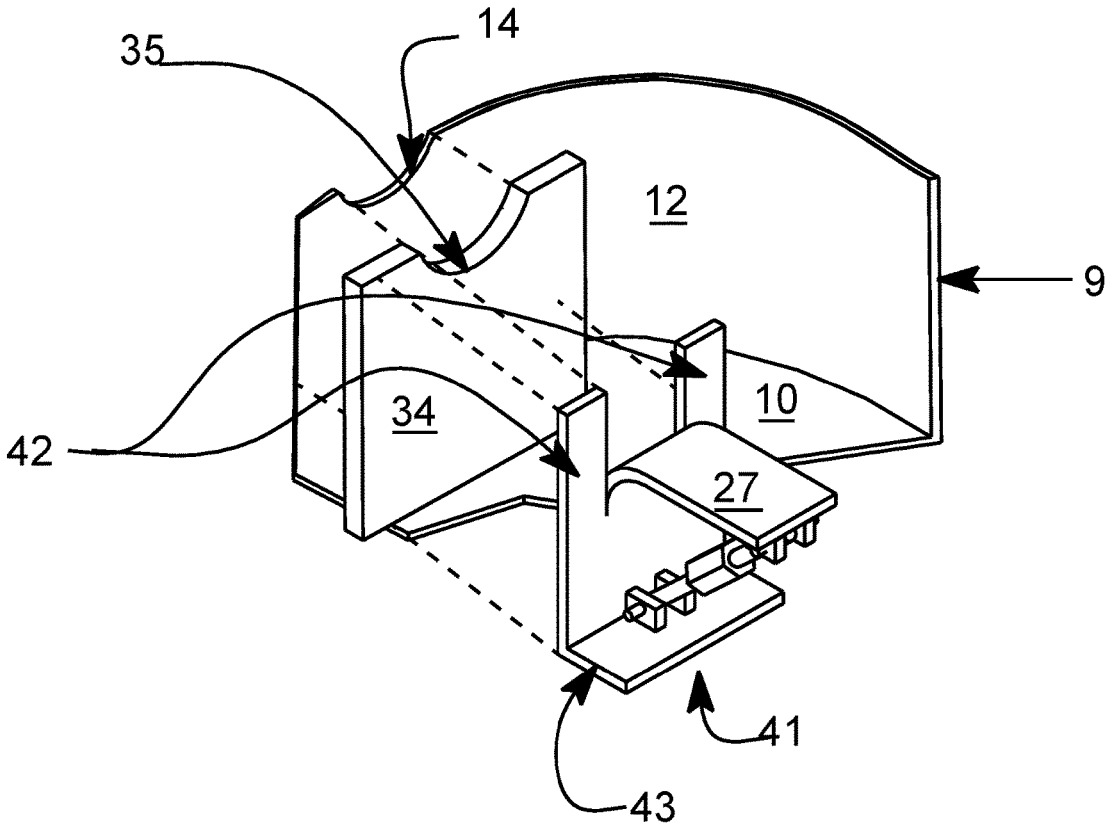
FIG. 7 shows a partial exploded perspective view of the present invention in an alternate embodiment.

FIG. 7 shows an alternate embodiment of an attachment bracket assembly apparatus 41. The said apparatus only differs from the previously attachment bracket assembly 15 in that the bottom leg 43 is extended in width and the bracket vertical leg 42 is extended both in width and height with a cut-out allowing bracket top leg 27 to remain unchanged with the resulting forked section of vertical leg 42 straddling each side of rim recess 14, when in position. This alternate embodiment makes for a more rigid and sturdier guitar neck to body jointing.

Soundboard 6 to fin flange 37 or neck rabbets 16 bonding may substitute for the need of any soundboard bracing in the region of said bonding.

As an alternate embodiment, neck to bracket attachment may be side by side. This means is useful in the case of cut-away guitars. And is comprised of: Joining a side surface of said bracket 15 top leg 27 to a side surface of the neck blank 8 tail. Means of joining, comprised of: extending the width on one side of the top bracket leg and interconnect as a tenon tongue with a respective mortise hole cut into neck blank tail; join a backing plate to a bracket top leg surface, at an off-set allowing for back plate to act as a tenon tongue fitted respectively to mortise hole cut into tail; previous example can also work when configured as rabbet joint; or angle stock may be respectively joined to a bracket top leg surface and a tail surface. Join bracket vertical leg outside surface to said rim interior surface beside and adjacent to attachment point as described in earlier embodiment. The respective placement position of neck does not change. Be sure to maintain a surface for tail to soundboard joining. Join the respective mating surfaces as explained in earlier described embodiment.

NEEDED OUTSIDE REFERENCES TO THE RELATED FIELD OF ART

The procedure Handbook of Arc Welding
Published by: The James F. Lincoln Arc Welding Foundation
P.O. Box 17035
Cleveland, Ohio 44117-0035
Lath Operations
Sub course No. OD1645
Edition 8
U.S. Army Correspondence Course Program
Machinery's Handbook
Edition 30
Published by Industrial Press

REFERENCE NUMERALS IN THE DRAWING

1—string nut
2—fretboard
3—frets
4—keyhole
5—bridge saddle
6—key hole soundboard
7—bridge
8—neck blank
9—rim
10—bottom board
11—waist
12—upper bout
13—rim adjustment port
14—rim neck recess/relief
15—neck attachment bracket assembly
16—neck tail stepped rabbet surface
17—neck (heel less)
18—neck head stock w/tuners
19—link pin tab eye
20—link pin
21—turnbuckle flat mount tab

22—threaded stud with eye
23—turn buckle strut assembly
24—barrel nut
25—right hand threads
26—left hand threads
27—top bracket leg
28—transition radius bend
29—vertical bracket leg
30—transition square bend
31—bottom bracket leg
32—guitar body
33—guitar body(prior art)
34—rim reinforcement veneer
35—veneer neck recess
36—sound board reinforcement veneer
37—fin flange
38—sound board (prior art)
39—neck (prior art)
40—neck heel block
41—alternate bracket embodiment
42—extended bracket vertical leg
43—extended bottom bracket Having described my invention, I claim:

1. A hollow body stringed musical instrument, comprised of:
(a) a body portion;
(b) a neck portion; and
(c) a neck to body adjustable attachment bracket portion, comprised of:
(i) a radius bend; and
(ii) a turnbuckle strut assembly allowing progressive adjustment of the radius length of said bend, whereby said bracket will adjustably affect the subsequent relative angle of inclination of said neck to said body.

2. A hollow body stringed musical instrument comprising a neck portion and a body portion, wherein:
(a) the neck portion is comprised of:
(i) a tail section comprising a stepped rabbet surface; and
(b) the body is a hollow box, comprised of:
(i) a rim portion defining the side parameter of said hollow box, comprised of:
(A) a upper bout section and a waist section, the end of the upper bout having a neck receiving recess cut-out;
(ii) a bottom board portion enclosing the bottom of the rim portion; and
(iii) a soundboard portion enclosing the top of the rim portion located opposite of the bottom board portion, comprised of:
(A) a cut-out to fit adjacent to the rim recess including a sound port, whereby allowing for the assembly of said neck to said body; and
(2) a surface, whereby allowing the Joining to the respective neck rabbet surface.

3. A hollow body stringed musical instrument comprising a neck portion and a body portion, wherein:
(a) the body portion Is comprised of:
(i) a soundboard including an internal and an exterior surface;
(b) the neck portion is, comprised of:
(i) a neck blank portion comprised of:
(A) a rectangular shaped tail section, comprised of:
(1) a bottom surface; and
(2) a stepped rabbet surface, whereby allowing for the respective joining to the soundboard surface;
(ii) a neck head stock with tuners;
(iii) a fret board portion with frets; and
(iv) a string nut.

4. A hollow body stringed musical instrument according to claim 1, wherein said neck portion is comprised of:
(a) a neck blank portion including a rectangular shaped tail section comprised of:
(i) a bottom surface; a top surface; and a side surface;
(iii) a fin flange section composed of angle stock including a vertical surface joined to a side surface of the neck blank tail section; and
(iv) a fin flange horizontal surface;
(b) a neck head stock with tuners;
(c) a fret board with frets; and
(d) a string nut.

5. A hollow body stringed musical instrument comprising a neck portion, a body portion and a said neck to a said body adjustable attachment bracket, wherein:
(a) said bracket is comprised of:
(i) a plurality of legs, comprised of:
(ii) a top leg including a top surface, a bottom surface, and a side surface;
(iii) a vertical leg including an outside surface, and an inside surface;
(iv) a curved radius bend transition between the top leg and the vertical leg resulting in an approximate 90 degree angle relative to said legs; and
(v) a turnbuckle strut assembly, comprised of:
(A) a threaded barrel nut; and
(B) a threaded stud; and
(b) the neck portion is, comprised of:
(i) a neck blank, comprised of:
(A) a tail section comprising a surface, whereby allowing the joining to the respective bracket top leg surface.

6. A hollow body stringed musical instrument according to claim 5 wherein said bracket is alternately embodied, comprised of:
(a) said bracket vertical leg is extended both in width and height with a cut-out allowing bracket top leg or leg transition to remain unchanged.

7. A hollow body stringed musical instrument comprising a neck portion and a body portion, wherein:
(a) the neck portion Is comprised of:
(i) a tail section including an attached fin flange including a surface; and
(b) the body portion is comprised of:
(i) a rim portion defining the side parameter of said hollow box, comprised of:
(A) a upper bout section and a waist section, the end of the upper bout having a neck receiving recess cut-out;
(B) a bottom board portion enclosing the bottom of the rim portion; and
(C) a soundboard portion enclosing the top of the rim portion located opposite of the bottom board portion, comprised of:
(1) a cut-out to fit adjacent to the rim recess including a sound port, whereby allowing for the assembly of said neck to said body; and
(2) a surface, whereby allowing the joining to the respective neck fin flange surface.

8. A hollow bodied guitar of the cut-away type comprising a neck portion, a body portion and a said neck to said body adjustable attachment bracket, wherein:

(a) the nook portion is, comprised of:

(i) a neck blank comprising a rectangular shaped tail section, comprised of:

(A) a stepped rabbet surface or a joined angle stock; or (B) a mortise hole cut into a side surface;

(b) the body portion is a hollow box comprising an interior surface, comprised of:

(i) a rim section defining the parameter of said box, comprised of:

(A) an upper bout section and a waist section; and (c) the attachment bracket is comprised of:

(i) a plurality of legs, comprised of:

(A) a vertical leg including an outside surface, whereby allowing the respective joining to the rim surface; and (B) a top leg including a surface, comprised of:

(1) one side of the top leg is extended in width, whereby allowing the leg to interconnect as a tenon tongue to a respective mortise hole cut into neck blank tail; or (2) the top leg surface allowing for the respective joining to the neck tail section.

* * * * *